US010368661B2

(12) United States Patent
Kiefer

(10) Patent No.: US 10,368,661 B2
(45) Date of Patent: Aug. 6, 2019

(54) DISPLAY APPARATUS HAVING ENHANCED TETHERING DEVICE AND SUPPORT HOUSING

(71) Applicant: WALH CLIPPER CORPORATION, Sterling, IL (US)

(72) Inventor: Jason Kiefer, Rock Falls, IL (US)

(73) Assignee: WAHL CLIPPER CORPORATION, Sterling, IL (US)

( * ) Notice: Subject to any disclaimer, the term of this patent is extended or adjusted under 35 U.S.C. 154(b) by 193 days.

(21) Appl. No.: 15/239,471

(22) Filed: Aug. 17, 2016

(65) Prior Publication Data

US 2017/0049249 A1 Feb. 23, 2017

Related U.S. Application Data

(60) Provisional application No. 62/207,278, filed on Aug. 19, 2015.

(51) Int. Cl.
*A47F 7/024* (2006.01)

(52) U.S. Cl.
CPC ..... *A47F 7/024* (2013.01)

(58) Field of Classification Search
CPC ..... A47F 7/024; E05B 73/00
USPC ..... 248/220.21, 220.41, 220.42, 220.43, 248/229.21, 227.1, 227.2, 250, 205.1
See application file for complete search history.

(56) References Cited

U.S. PATENT DOCUMENTS 6,419,175 B1 * 7/2002 Rankin, VI ..... A45F 5/004 242/373
6,644,606 B1 * 11/2003 Seidel ..... G09F 7/18 248/220.41
7,385,522 B2 * 6/2008 Belden, Jr. ..... A47F 5/0861 248/551
8,292,097 B2 * 10/2012 Goldberg ..... A47F 7/024 206/560
8,474,781 B2 * 7/2013 Deguglimo ..... A47F 5/0068 108/97
9,830,787 B2 * 11/2017 Fawcett ..... G08B 13/1418
2003/0106971 A1 * 6/2003 Leyden ..... E05B 73/0005 248/187.1
2009/0058643 A1 * 3/2009 Groth ..... G08B 13/128 340/568.1
2009/0173868 A1 * 7/2009 Fawcett ..... A47F 7/024 248/551

* cited by examiner

*Primary Examiner* — Kimberly T Wood
(74) *Attorney, Agent, or Firm* — Greer, Burns & Crain, Ltd.

(57) ABSTRACT

A display apparatus is provided for displaying a sample product with a display shelf. Included in the display apparatus is an upper housing member having an upper surface and a socket disposed on the upper surface. The socket is configured for accommodating an insertion of the sample product for loosely supporting the sample product during display. A lower housing member is attached to the upper housing member, and has a tethering device configured for connecting the sample product to the display apparatus under the action of a windup reel. The upper housing member includes a mounting block configured for being removably mountable under the display shelf and attachable on and depending from a front edge of the display shelf, such that the sample product inserted into the socket is accessible by a customer.

18 Claims, 6 Drawing Sheets

DISPLAY APPARATUS HAVING ENHANCED TETHERING DEVICE AND SUPPORT HOUSING

CROSS-REFERENCE

The present application claims priority to U.S. provisional patent application Ser. No. 62/207,278 filed on Aug. 19, 2015 under 35 U.S.C. § 119(e), which is incorporated by reference.

BACKGROUND

The present disclosure generally relates to supporting fixtures, and more particularly relates to an improved display apparatus whereby a potential consumer can more readily grasp and handle the product without opening a package.

Conventional display fixtures and devices are commonly used in retail stores and similar business establishments for displaying and storing non-functional products on a tabletop display shelf, such as a gondola or other suitable display counter. To draw attention of customers, the products are attractively displayed and placed on the display shelf outside any packaging to be readily examined and handled by the customers during store operation. Thus, it is desirable to display the products within easy reach of the customers such that the customers can instantly touch, handle and learn about the products without purchase, and without opening packages.

In most retail establishments, suppliers are allotted a finite amount of shelf space for products. When display samples are conventionally used, conventional display devices are placed on top of the gondola-type display counter with display shelves and supporting fixtures. Sample non-functional products are displayed on the display shelves and secured to the shelves using the supporting fixtures. In this arrangement, at least some portions of the display shelves are occupied by the sample products and their supporting fixtures, thereby leaving less storage space for other products. As a result, there is less room for products on the display counter, reducing potential inventory for the vendor or supplier.

Consequently, more restocking time and space is necessary for the store operators. Further, it is difficult for the customers to access the sample products when they are disposed in-between upper and lower shelves. Thus, an enhanced display apparatus is needed to afford more storage space on the display shelves, and to save operating time and related expenses.

SUMMARY

The above-mentioned issues are addressed by the present display apparatus that promotes an improved storage space on the display shelves, and provides easy access to the sample products for the customers. An important aspect of the present display apparatus is that the display apparatus is mountable under and depending from the display shelf or counter so that the display apparatus is at least partially hidden from the customers, and is attachable on a front edge of the display shelf. In this configuration, easy access to the sample products is provided to the customers without significantly reducing product storage space.

In one embodiment, a display apparatus is provided for displaying a sample product with a display shelf. Included in the display apparatus is an upper housing member having a socket disposed on an upper surface of the upper housing member, and the socket is configured for accommodating an insertion of the sample product for loosely supporting the sample product during display. A lower housing member is attached to the upper housing member, and has a tethering device configured for connecting the sample product to the display apparatus under the action of a windup reel. The upper housing member includes a mounting block configured for being removably mountable under the display shelf and attachable on and depending from a front edge of the display shelf, such that the sample product inserted into the socket is accessible by a customer.

In another embodiment, a display apparatus is provided for displaying a sample product with a display shelf. Included in the display apparatus is an upper housing member configured for supporting the sample product on the upper housing member during display. A cavity is disposed on an upper surface of the upper housing member near a middle portion of the upper housing member, and is configured for receiving a front edge of the display shelf. A lower housing member is attached to the upper housing member, and has a tethering device configured for connecting the sample product to the display apparatus under the action of a windup reel. The upper housing member includes a mounting block configured for being removably mountable under the display shelf and attachable on and depending from the front edge of the display shelf, such that the sample product is accessible by a customer.

In yet another embodiment, a display apparatus is provided for displaying a sample product with a display shelf. Included in the display apparatus is an upper housing member configured for supporting the sample product on the upper housing member during display. A lower housing member is attached to the upper housing member, and has a tethering device configured for connecting the sample product to the display apparatus under the action of a windup reel. A tether is connected at one end to the windup reel of the tethering device, and at an opposite end to the sample product. The upper housing member includes a mounting block configured for being removably mountable under the display shelf and attachable on and depending from a front edge of the display shelf, such that the sample product is accessible by a customer.

DETAILED DESCRIPTION

Figure 1:
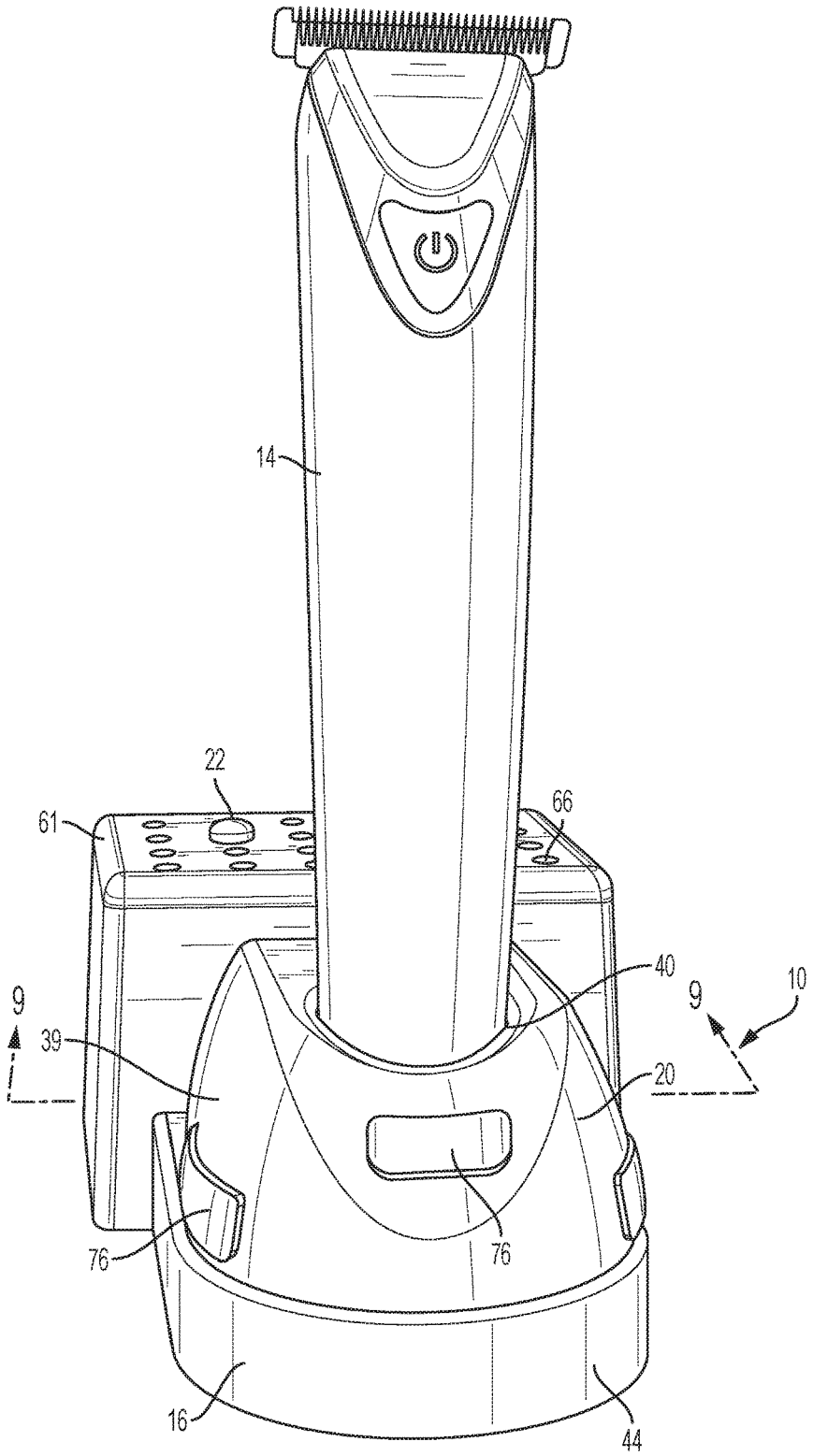
FIG. 1 is a front perspective view of the present display apparatus, featuring a lower housing member and an upper housing member holding a sample product.
Figure 2:
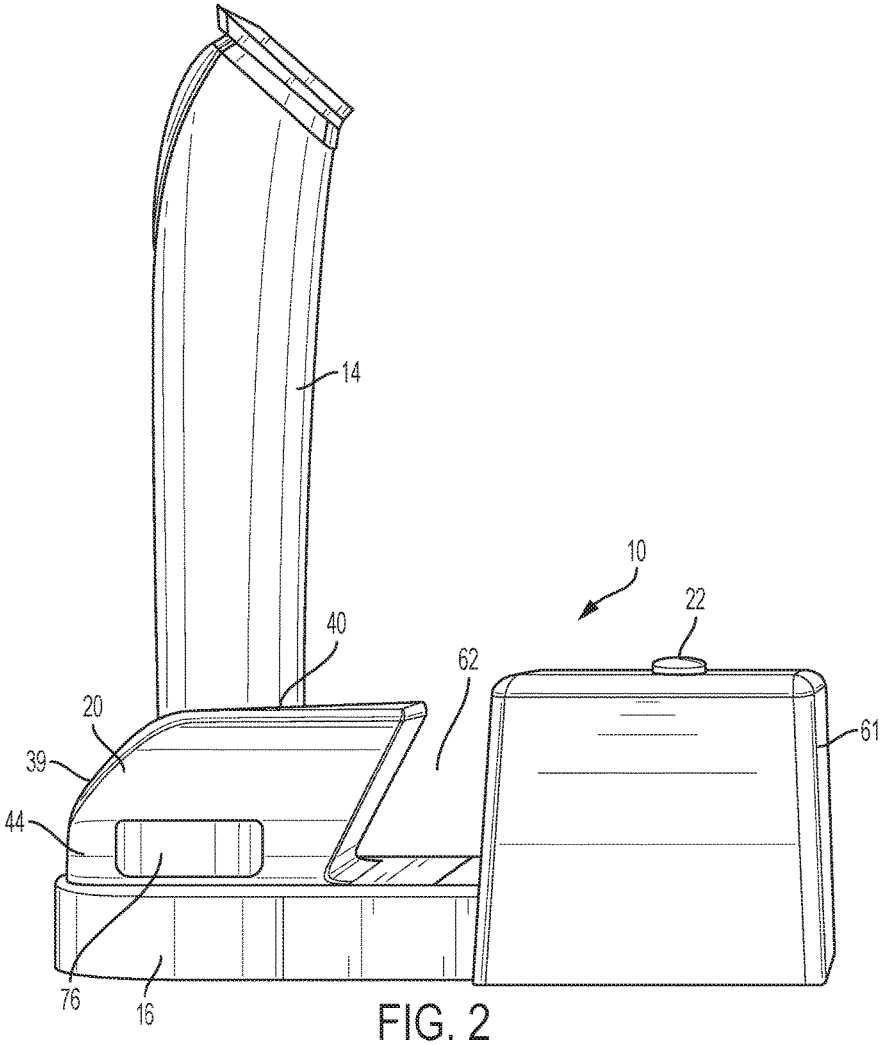
FIG. 2 is a side view of the present display apparatus of FIG. 1.
Figure 3:
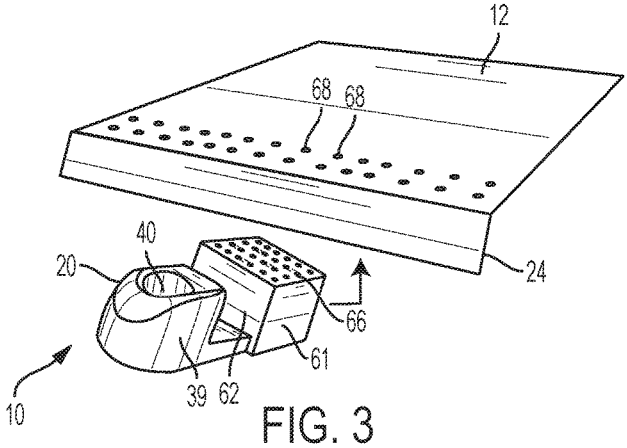
FIGS. 3 and 4 depict an exemplary way of attaching the present display apparatus to a conventional gondola-type shelf.

Referring now to FIGS. 1-4 and 8, the present display apparatus, generally designated 10, is constructed and arranged to provide additional product storage space on a display shelf 12, and easy access to a sample product 14 for a customer. FIG. 1 shows the sample product 14 being displayed on the present display apparatus 10. It is preferred that the present display apparatus 10 includes a lower housing member 16 having a planar surface 18, and an upper housing member 20 having an elongated body. A longitudinal length of the lower housing member 16 is variable depending on the application. Attachment of the lower and upper housing members 16, 20 is achieved by at least one fastener 22, such as a helically threaded screw or other suitable fastener known in the art. Different methods of attaching the lower and upper housing members 16, 20 are also contemplated, such as applying adhesives or welding, to suit the application.

An important aspect of the present display apparatus 10 is that the display apparatus is mountable under the display shelf 12, and is attachable on and depending from a front edge 24 of the display shelf. In this arrangement, the sample product 14 is placed in front of the front edge 24 of the display shelf 12, and does not occupy any space on the display shelf. Thus, extra storage space is available for products on the display shelf 12, and at the same time, the customer can readily touch, handle and learn about the sample product 14.

In use, the upper housing member 20 is removably attached to the display shelf 12, and the upper housing member loosely supports the sample product 14 during display. Attachment of the upper housing member 20 to the display shelf 12 is achieved by using at least one fastener 22 or other suitable technology, and optionally the fasteners are secured with corresponding wing nuts 23. Other known removable fasteners are contemplated for securing the upper housing member 20 to the display shelf 12. It is preferred that the upper housing member 20 is molded in a unitary construction having an integrally molded body. Detailed arrangements of the lower and upper housing member 16, 20 are described below in paragraphs relating to FIGS. 5-10.

Referring now to FIGS. 1 and 5-8, it is contemplated that the lower housing member 16 includes a tethering device, generally designated 26 (FIG. 7), configured for providing an automatic recoil or pulling of the sample product 14 under the action of a windup reel 28, also referred to as a spring-loaded, retractable reel. It is contemplated that the windup reel 28 includes a biasing or tension device 30, such as a spring or other winding mechanisms known in the art. At least one counterbalance or a wire harness positioner 32 is used in the tethering device 26 for creating a reliable tension for countering a variety of forces exerted by the customer.

It is contemplated that a tether or wire 34 is connected at one end to the windup reel 28 of the tethering device 26, and at an opposite end to the sample product 14 via a channel 36 disposed in the lower housing member 16. The tether 34 is used as a security string for the sample product 14, and is made of metal, plastic, or other suitable resilient materials known in the art.

In the preferred embodiment, the channel 36 is disposed, at least partially, on a bottom surface 38 of the lower housing member 16 so that the tether 34 is hidden and protected from friction. For example, when the customer picks up the sample product 14 from the present display apparatus 10, the tether 34 is extended from the tethering device 26 through the channel 36 for easy examination of the sample product.

After examination, the tether 34 is retracted back to the tethering device 26 through the channel 36 under the action of the windup reel 28. An exemplary tension force of the tether 34 is approximately 0.5 pounds, which is commensurate with an actual weight of the sample product 14. For example, a minimum tension force of the tether 34 provides an approximately 65 percent (%) weight of the sample product 14.

Referring now to FIGS. 1, 4, 5, 7, 9 and 10, it is preferred that the upper housing member 20 includes a retention block 39 having a socket 40 disposed on an upper surface 42 near a front portion 44 of the upper housing member 20, and configured for accommodating an insertion of the sample product 14.

Figure 7:
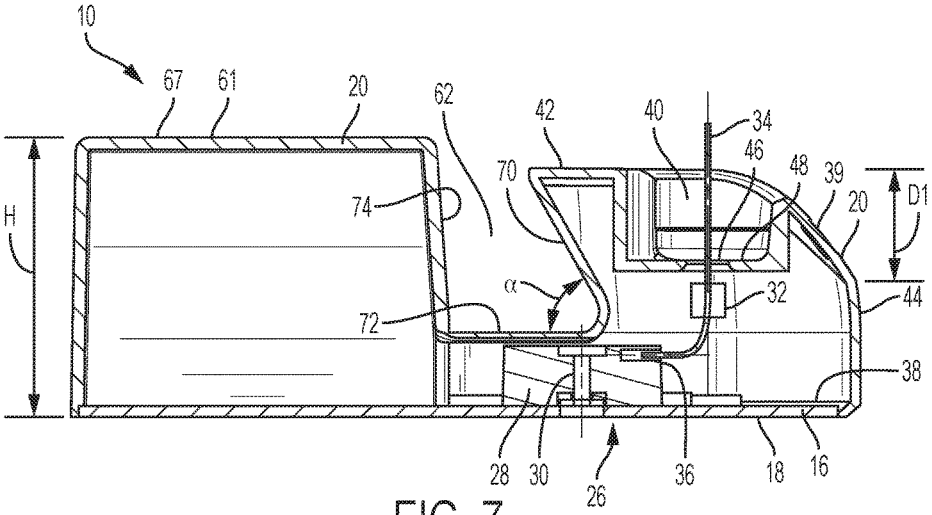
FIG. 7 is a vertical cross-section of the present display apparatus, taken along the line 7-7 of FIG. 6.
Figure 8:
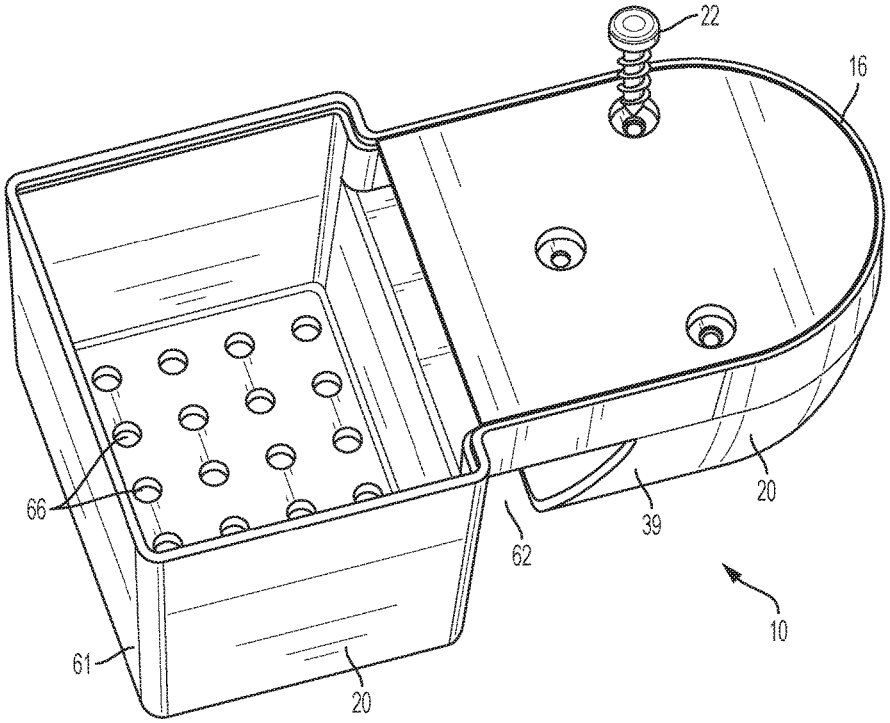
FIG. 8 is a bottom view of the present display apparatus of FIG. 5.

It is contemplated that a depth D1 of the socket 40 is at least approximately 12.5% of an overall height H1 of the upper housing member 20. A throughbore 46 (FIG. 6) is disposed in the socket 40 of the upper housing member 20, such that the tether 34 is retractable or extendable via the throughbore and the channel 36 (FIG. 7). Since the tether 34 is attached to the sample product 14, the tether travels or reciprocates in fluid communication within the throughbore 46 and the channel 36 during use.

While a straight groove or a linear configuration for the channel 36 and the throughbore 46 is shown for illustration purposes, other suitable arrangements, such as a "C"- or "L"-shaped channel or throughbore, are contemplated to suit different applications. It is contemplated that a protective sleeve or guard 48 is provided in the lower or upper housing member 16, 20 to prevent excessive wear and tear of the channel 36 and/or throughbore 46 by the reciprocal movement of the tether 34.

Figure 9:
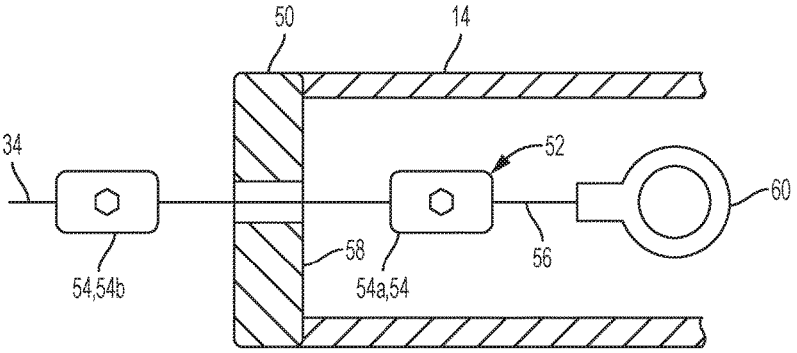
FIG. 9 is a schematic horizontal cross-section of the sample product featuring a tether taken along the line 9-9 of FIG. 1.
Figure 10:
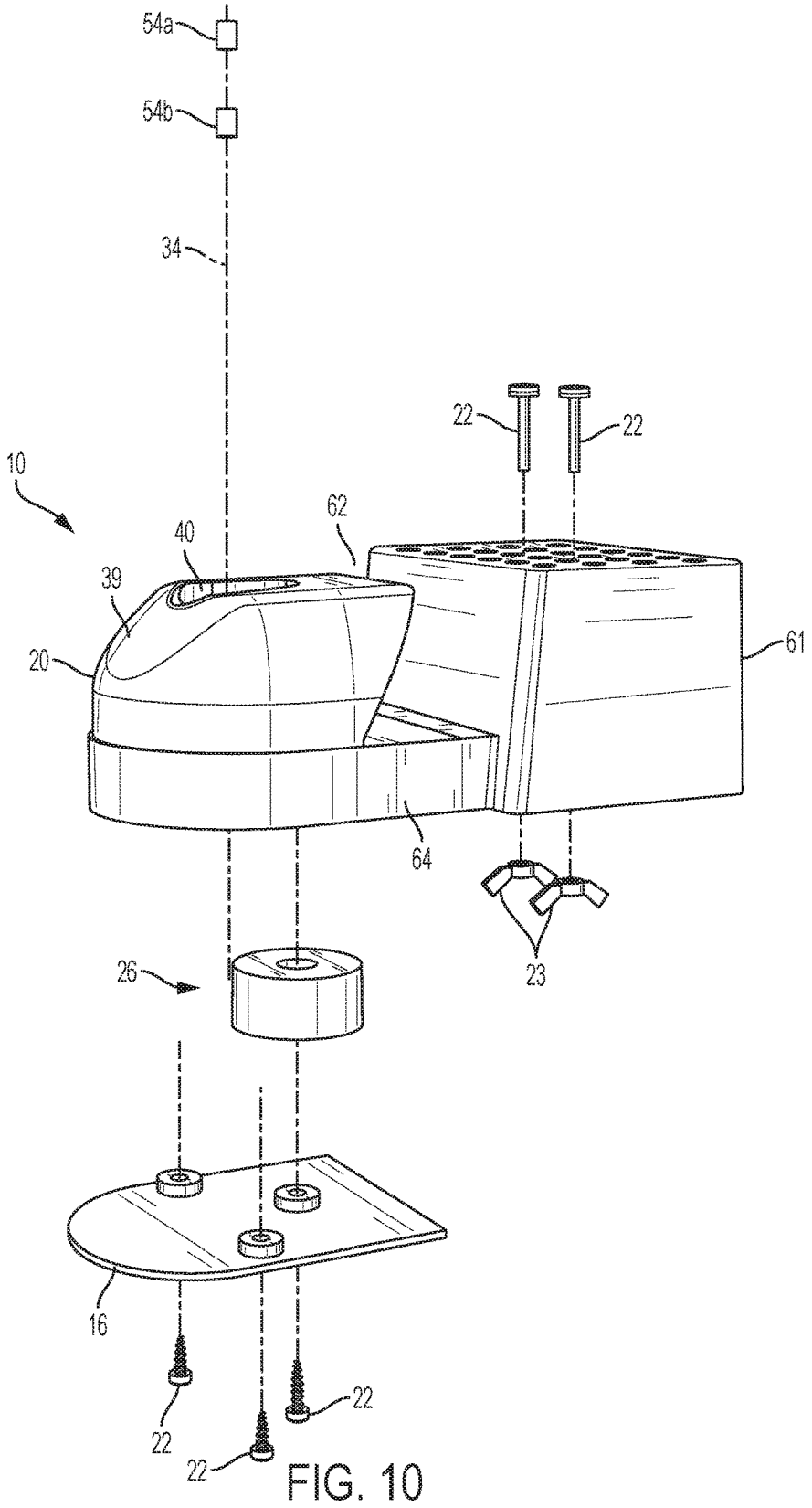
FIG. 10 is an exploded view of the present display apparatus of FIG. 5.

Referring now to FIG. 9, it is preferred that the tether 34 is attached to a bottom piece 50 of the sample product 14 using an end fitting 52 having at least one stopper 54, such as a metal ball. It is contemplated that a first stopper 54*a* is removably secured on a distal end 56 of the tether 34 such that the first stopper engages an inner surface 58 of the bottom piece 50 under the action of the tethering device 26. Thus, the sample product 14 is automatically retracted back into the socket 40 of the upper housing member 20 when the examination is completed by the customer. Optionally, a second stopper 54*b* is removably secured on the tether 34 opposite the first stopper 54*a* such that the bottom piece 50 is sandwiched between the first and second stoppers 54*a*, 54*b*. Other suitable end fittings, such as a ring or loop terminal 60, are also contemplated to suit the application.

At an opposite end of the present display apparatus 10, the upper housing member 20 includes a mounting block 61 configured for accommodating an attachment of the present display apparatus to the display shelf 12. In a preferred embodiment, a cavity 62 is disposed between the retention block 39 and the mounting block 61 near a middle portion 64 of the upper housing member, and is configured for receiving the front edge 24 of the display shelf 12. For facilitating the attachment of the present display apparatus 10 to the display shelf 12, the front edge 24 of the display shelf is inserted into the cavity 62.

Figure 4:
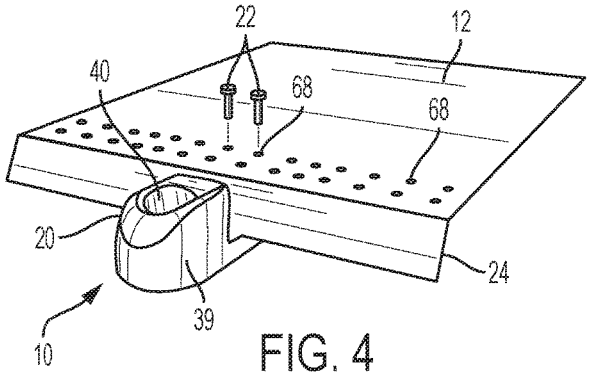
Figure 5:
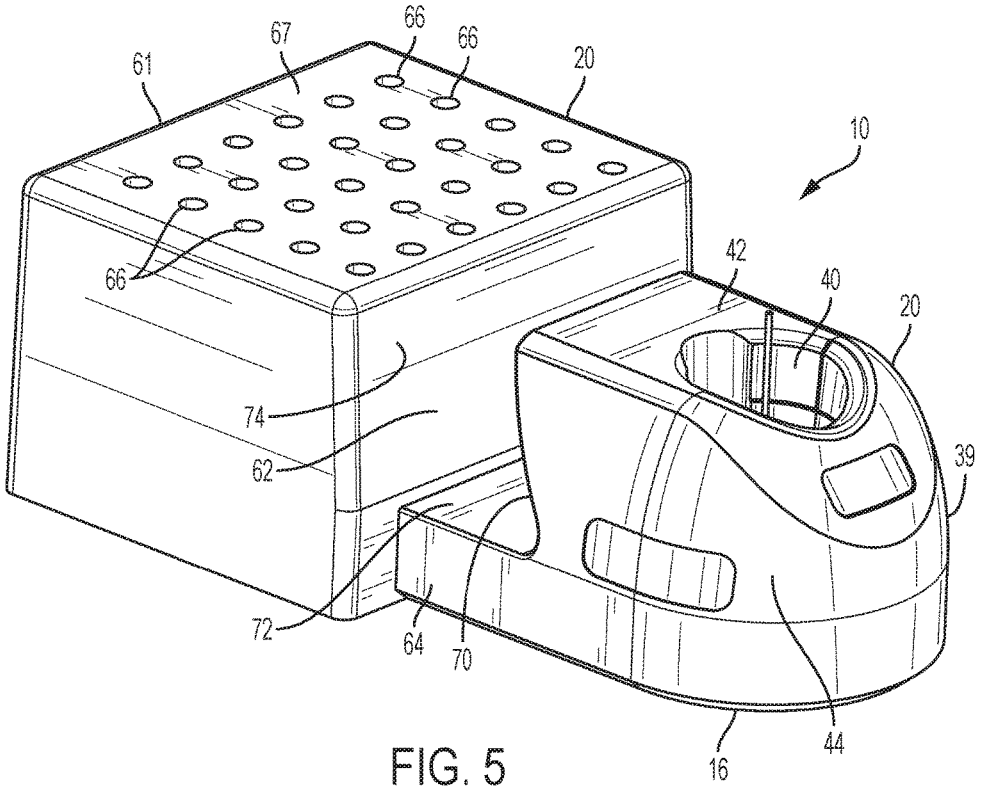
FIG. 5 is a front perspective view of the present display apparatus.
Figure 6:
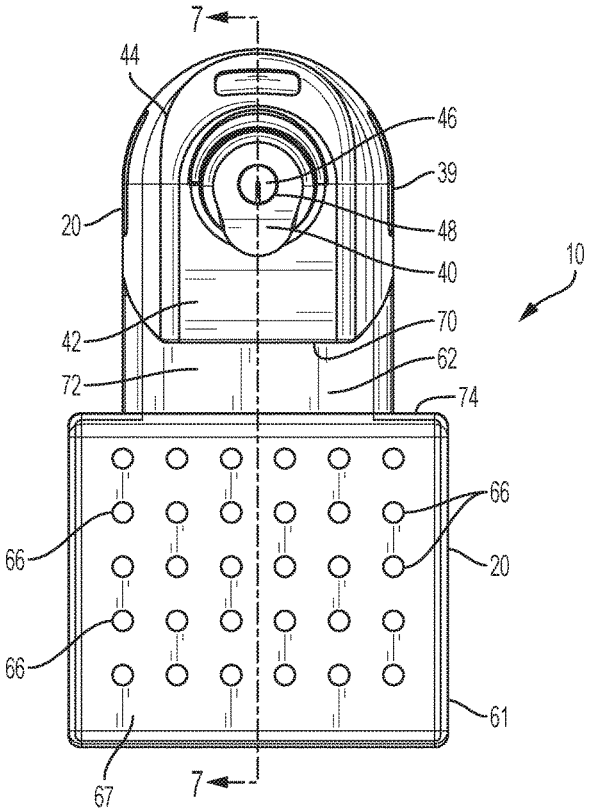
FIG. 6 is a plan view of the present display apparatus of FIG. 5.

A plurality of threaded bores or openings 66 are provided on an upper surface 67 of the mounting block 61 for receiving the fasteners 22 such that the openings are aligned with corresponding openings 68 of the display shelf 12 in complementary relationship (FIG. 4). Other types of attachment methods, using adhesives, hook and loop fasteners, or slide and lock mechanisms, are also contemplated to suit different applications.

It is preferred that a front inner surface 70 (FIG. 7) of the cavity 62 is angled or inclined at a predetermined angle α for accommodating an insertion of the front edge 24 of the display shelf 12. An exemplary angle α between a bottom surface 72 of the cavity 62 and the front inner surface 70 is approximately 60 degrees. Other suitable angles are contemplated depending on the types of other display shelves. Further, a rear inner surface 74 of the cavity 62 is substantially transverse to the bottom surface 72 of the cavity, such that the rear inner surface and the bottom surface are joined at a substantially right angle (i.e., approximately 90°).

While an elongated round shape is shown for the upper housing member 20, other geometric arrangements, such as a cylindrical tube, a rectangular conduit, or a hexagonal spout, are also contemplated depending on a particular shape of the sample product 14. Optionally, an information plate 76 (FIGS. 1 and 2) is disposed on the front portion 44 of the upper housing member 20 for describing the sample product 14, such as a product name or a manufacturer's name. Other suitable locations of the plate 76 on the upper housing member 20 are contemplated.

While a particular embodiment of the present display apparatus has been shown and described, it will be appreciated by those skilled in the art that changes and modifications may be made thereto without departing from the present disclosure in its broader aspects and as set forth in the following claims.

What is claimed is:

1. A display apparatus for displaying a sample product with a display shelf, the display apparatus comprising:

an upper housing member having a first upper surface and a socket disposed on the first upper surface, the socket being configured for accommodating an insertion of the sample product for loosely supporting the sample product during display;

a lower housing member removably attached to the upper housing member, having a tethering device configured for connecting the sample product to the display apparatus under the action of a windup reel; and a mounting block located on the upper housing member, said mounting block being separated from said socket by a portion of the shelf, and said mounting block having a plurality of openings on a mounting upper surface of the mounting block, so that said apparatus is secured to the shelf at said mounting block, and said mounting block having said mounting upper surface disposed vertically above said first upper surface of said upper housing member when said display apparatus is attached to the display shelf, said mounting block being configured for being removably mountable under the display shelf and attachable on and depending from a front edge of the display shelf, such that the sample product inserted into the socket is accessible by a customer.

2. The display apparatus of claim 1, wherein the lower housing member has a planar surface, and the upper housing member has an elongated body.

3. The display apparatus of claim 1, wherein the tethering device is configured for providing an automatic pulling of the sample product under the action of the windup reel.

4. The display apparatus of claim 1, wherein the windup reel includes a biasing device.

5. The display apparatus of claim 1, wherein the tethering device includes at least one wire harness positioner configured for creating a reliable tension at a variety of forces exerted by the customer.

6. The display apparatus of claim 1, wherein a tether is connected at one end to the windup reel of the tethering device, and at an opposite end to the sample product.

7. The display apparatus of claim 6, wherein a channel is disposed, at least partially, on a bottom surface of the lower housing member so that the tether is hidden and protected from friction.

8. The display apparatus of claim 6, wherein a minimum tension force of the tether is approximately 65 percent weight of the sample product.

9. The display apparatus of claim 1, wherein the socket of the upper housing member is disposed near a front portion of the upper housing member.

10. The display apparatus of claim 1, wherein a depth of the socket is at least approximately 12.5 percent of an overall height of the upper housing member.

11. The display apparatus of claim 6, wherein a throughbore is disposed in the socket of the upper housing member, such that the tether is retractable or extendable via the throughbore.

12. The display apparatus of claim 11, wherein a protective guard is disposed in at least one of the lower and upper housing members for preventing excessive wear and tear of the throughbore.

13. The display apparatus of claim 6, wherein the tether is attached to a bottom piece of the sample product using an end fitting having at least one stopper.

14. The display apparatus of claim 13, wherein a first stopper is removably secured on a distal end of the tether such that the first stopper engages an inner surface of the bottom piece under the action of the tethering device.

15. The display apparatus of claim 14, wherein a second stopper is removably secured on the tether opposite the first stopper such that the bottom piece is sandwiched between the first and second stoppers.

16. The display apparatus of claim 1, wherein said mounting block being separated from said socket defines a cavity disposed on the first upper surface of the upper housing member near a middle portion of the upper housing member, and is configured for receiving the front edge of the display shelf.

17. The display apparatus of claim 16, wherein a front inner surface of the cavity is included at a predetermined oblique angle for accommodating an insertion of the front edge of the display shelf.

18. A display apparatus for displaying a sample product with a display shelf, the display apparatus comprising:

an upper housing member configured for supporting the sample product on the upper housing member during display;

a cavity disposed on a first upper surface of the upper housing member near a middle portion of the upper housing member, and configured for receiving a front edge of the display shelf;

a lower housing member attached to the upper housing member, having a tethering device configured for connecting the sample product to the display apparatus under the action of a windup reel; and a mounting block of the upper housing member having a plurality of openings on a mounting upper surface and configured for being removably mountable under the display shelf and attachable on and depending from the front edge of the display shelf, such that the sample product is accessible by a customer, said mounting upper surface of said mounting block being disposed above said first upper surface of said upper housing member; and said cavity is configured for receiving a front edge of the display shelf and includes a front inner surface being angled at approximately 60 degrees relative to a bottom surface of said cavity, and is complementary to an angle of the front edge of the display shelf.

* * * * *